US006869337B2

(12) United States Patent
Boyd et al.

(10) Patent No.: US 6,869,337 B2
(45) Date of Patent: Mar. 22, 2005

(54) SYSTEM AND METHOD FOR POLISHING AND PLANARIZING SEMICONDUCTOR WAFERS USING REDUCED SURFACE AREA POLISHING PADS AND VARIABLE PARTIAL PAD-WAFER OVERLAPPING TECHNIQUES

(75) Inventors: John M. Boyd, Atascadero, CA (US); Yehiel Gotkis, Fremont, CA (US); Rod Kistler, Los Gatos, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/770,599

(22) Filed: Feb. 3, 2004

(65) Prior Publication Data

US 2004/0166782 A1 Aug. 26, 2004

Related U.S. Application Data

(60) Division of application No. 09/754,480, filed on Jan. 4, 2001, now Pat. No. 6,705,930, which is a continuation-in-part of application No. 09/493,978, filed on Jan. 28, 2000, now Pat. No. 6,340,326.

(51) Int. Cl.[7] ..... B24B 1/00
(52) U.S. Cl. ..... 451/41; 451/57; 451/285
(58) Field of Search ..... 451/41, 56, 72, 451/285, 287, 288, 443, 57, 59, 65, 286

(56) References Cited

U.S. PATENT DOCUMENTS

| | | | |
|---|---|---|---|
| 3,589,078 | A | 6/1971 | Bala et al. |
| 4,128,968 | A | 12/1978 | Jones |
| 4,144,099 | A | 3/1979 | Edmonds et al. |
| 4,197,676 | A | 4/1980 | Sauerland |

(List continued on next page.)

FOREIGN PATENT DOCUMENTS

| | | | |
|---|---|---|---|
| EP | 0 150 074 | A2 | 7/1985 |
| EP | 0 180 175 | A2 | 5/1986 |
| EP | 0 272 531 | B1 | 6/1988 |
| EP | 0 272 531 | A1 | 6/1988 |
| EP | 0 337 379 | A2 | 10/1989 |
| EP | 0 754 525 | A1 | 1/1997 |
| EP | 0 916 452 | A2 | 5/1999 |
| EP | 0 992 322 | A1 | 4/2000 |
| EP | 1 057 591 | A2 | 12/2000 |
| GB | 2 324 750 | A | 11/1998 |
| JP | 7-111256 | | 4/1995 |
| JP | 2000-015557 | | 1/2000 |
| WO | WO 82/03038 | | 9/1982 |
| WO | WO 00/53371 | | 9/2000 |

OTHER PUBLICATIONS

PCT Search Report dated Dec. 16, 2002 for corresponding PCT/US01/48658.

Copy of a Patent Abstracts of Japan, for Publication No. 05318325, Publication Date Mar. 12, 1993, "Grinding Wheel For Grinding Work And Its Electrolytic Dressing Method", 1 page.

(List continued on next page.)

*Primary Examiner*—Dung Van Nguyen
(74) *Attorney, Agent, or Firm*—Brinks Hofer Gilson & Lione

(57) ABSTRACT

A system and method for polishing semiconductor wafers includes a variable partial pad-wafer overlap polisher having a reduced surface area, fixed-abrasive polishing pad and a polisher having a non-abrasive polishing pad for use with an abrasive slurry. The method includes first polishing a wafer with the variable partial pad-wafer overlap polisher and the fixed-abrasive polishing pad and then polishing the wafer in a dispersed-abrasive process until a desired wafer thickness is achieved.

10 Claims, 6 Drawing Sheets

U.S. PATENT DOCUMENTS 4,232,485 A 11/1980 Eadon-Allen
4,358,338 A 11/1982 Downey et al.
4,462,860 A 7/1984 Szmanda
4,693,036 A 9/1987 Mori
5,177,908 A 1/1993 Tuttle
5,245,790 A 9/1993 Jerbic
5,265,378 A 11/1993 Rostoker
5,310,455 A 5/1994 Pasch et al.
5,321,304 A 6/1994 Rostoker
5,389,194 A 2/1995 Rostoker et al.
5,403,228 A 4/1995 Pasch
5,441,444 A 8/1995 Nakajima
5,508,077 A 4/1996 Chen et al.
5,516,400 A 5/1996 Pasch et al.
5,599,423 A 2/1997 Parker et al.
5,624,304 A 4/1997 Pasch et al.
5,632,873 A 5/1997 Stevens et al.
5,645,469 A 7/1997 Burke et al.
5,667,433 A 9/1997 Mallon
5,672,095 A 9/1997 Morimoto et al.
5,709,593 A 1/1998 Guthrie et al.
5,736,427 A 4/1998 Henderson
5,861,055 A 1/1999 Allman et al.
5,865,666 A 2/1999 Nagahara
5,868,608 A 2/1999 Allman et al.
5,882,251 A 3/1999 Berman et al.
5,888,120 A 3/1999 Doran
5,893,756 A 4/1999 Berman et al.
5,895,270 A 4/1999 Hempel, Jr.
5,897,426 A 4/1999 Somekh
5,913,712 A * 6/1999 Molinar ..... 451/41
5,919,082 A 7/1999 Walker et al.
5,948,697 A 9/1999 Hata
5,957,757 A 9/1999 Berman
5,964,646 A 10/1999 Kassir et al.
5,969,521 A 10/1999 Kurita et al.
5,972,162 A 10/1999 Cesna
5,975,991 A 11/1999 Karlsrud
5,975,994 A 11/1999 Sandhu et al.
6,004,193 A 12/1999 Nagahara et al.
6,004,196 A 12/1999 Doan et al.
6,010,538 A 1/2000 Sun et al.
6,030,488 A 2/2000 Izumi et al.
6,041,465 A 3/2000 Yashiki et al.
6,048,259 A 4/2000 Asai
6,062,954 A 5/2000 Izumi
6,066,230 A 5/2000 Arai
6,068,545 A 5/2000 Arai
6,074,275 A 6/2000 Yashiki et al.
6,074,277 A 6/2000 Arai
6,075,606 A 6/2000 Doan
6,083,082 A 7/2000 Saldana
6,093,087 A 7/2000 Hakomori et al.
6,102,784 A 8/2000 Lichner
6,106,662 A 8/2000 Bibby, Jr. et al.
6,113,478 A 9/2000 Anderson, III et al.
6,168,508 B1 1/2001 Nagahara et al.
6,220,945 B1 * 4/2001 Hirokawa et al. ..... 451/287
6,328,632 B1 12/2001 Chopra
6,340,326 B1 1/2002 Kistler et al.
6,402,588 B1 6/2002 Matsuo et al.
6,431,959 B1 8/2002 Mikhaylich et al.
6,620,725 B1 * 9/2003 Shue et al. ..... 438/633
2002/0137436 A1 9/2002 Kistler et al.

OTHER PUBLICATIONS

Copy of a Patent Abstracts of Japan, for Publication No. 2000015557, Publication Date Jan. 18, 2000, "Polishing Device", 1 page.

Copy of International Search Report received for PCT application No. US01/01044, Filed on Jan. 12, 2001, date of mailing May 21, 2001, 8 pages.

Copy of Search Report for Application No. 01 988 320.6–1262 dated Apr. 29, 2004.

* cited by examiner

SYSTEM AND METHOD FOR POLISHING AND PLANARIZING SEMICONDUCTOR WAFERS USING REDUCED SURFACE AREA POLISHING PADS AND VARIABLE PARTIAL PAD-WAFER OVERLAPPING TECHNIQUES

CROSS-REFERENCE TO RELATED APPLICATIONS

This application is a divisional of U.S. application Ser. No. 09/754,480 filed Jan. 4, 2001, now U.S. Pat. No. 6,705,930, which is a continuation-in-part of U.S. application Ser. No. 09/493,978 filed Jan. 28, 2000, now U.S. Pat. No. 6,340,326 B1. The entirety of each of the disclosures of the aforementioned U.S. patent applications is incorporated by reference herein.

FIELD OF THE INVENTION

The present invention relates to planarization of semiconductor wafers using a chemical mechanical planarization technique. More particularly, the present invention relates to an improved system and method for planarizing semiconductor wafers using variable partial pad-wafer overlapping techniques with both fixed-abrasive and dispersed-abrasive polishing media.

BACKGROUND

Semiconductor wafers are typically fabricated with multiple copies of a desired integrated circuit design that will later be separated and made into individual chips. A common technique for forming the circuitry on a semiconductor wafer is photolithography. Part of the photolithography process requires that a special camera focus on the wafer to project an image of the circuit on the wafer. The ability of the camera to focus on the surface of the wafer is often adversely affected by inconsistencies or unevenness in the wafer surface. This sensitivity is accentuated with the current drive for smaller, more highly integrated circuit designs which cannot tolerate certain nonuniformities within a particular die or between a plurality of dies on a wafer. Because semiconductor circuit on wafers are commonly constructed in layers, where a portion of a circuit is created on a first layer and conductive vias connect it to a portion of the circuit on the next layer, each layer can add or create topography on the wafer that must be smoothed out before generating the next layer. Chemical mechanical planarization (Oxide-CMP) techniques are used to planarize and polish each layer of a wafer. CMP (Metal-CMP) is also widely used to shape within-die metal plugs and wires, removing excess metal from the wafer surface and only leaving metal within the desired plugs and trenches on the wafer. Available CMP systems, commonly called wafer polishers, often use a rotating wafer holder that brings the wafer into contact with, for the most conventional rotary CMP machines, a polishing pad rotating in the plane of the wafer surface to be planarized. A chemical polishing agent or slurry containing microabrasives and surface modifying chemicals is applied to the polishing pad to polish the wafer. The wafer holder then presses the wafer against the rotating polishing pad and is rotated to polish and planarize the wafer. Some available wafer polishers use orbital motion, or a linear belt rather than a rotating surface to carry the polishing pad. In all instances, the surface of the wafer is often completely covered by, and in contact with, the polishing pad to simultaneously polish the entire surface.

One drawback of polishing the entire surface simultaneously is that the various circuits on the wafer may have a different response to the CMP process, even if the wafer begins the CMP process perfectly flat. This may be due to the different types of materials deposited on parts of the wafer or the density of materials on a certain portion of the wafer. Simultaneous polishing of the entire surface also often clears some spots of the wafer faster than others because of the different material properties. The uneven clearance results in over polishing of certain areas of the wafer. Additionally, various material processes used in formation of wafers provide specific challenges to providing a uniform CMP polish to a wafer. Certain processes, such as the copper dual damascene process, can be particularly sensitive to the overpolishing that may occur in polishers that simultaneously polish the entire surface of a wafer.

The trend to process larger diameter wafers has introduced an additional level of difficulty to the CMP process by requiring uniformity over a greater surface area. Using traditional CMP techniques, in which the entire surface of a wafer is covered by the polishing pad, larger diameter wafers significantly increase loading distribution requirements on the polishing pad or wafer in order to avoid pressure variations on the surface of the wafer as achieved with smaller diameter wafers. Fixed-abrasive polishing pads are sometimes desirable to perform some particular phases of the polishing process, however fixed-abrasive polishing pads can require even greater pressures than traditional non-abrasive pads to take full advantage of the planarization capabilities of the fixed-abrasive material.

Accordingly, there is a need for a method and system of performing chemical mechanical planarization and polishing that addresses these issues.

DETAILED DESCRIPTION OF THE PRESENTLY PREFERRED EMBODIMENTS

In order to address the drawbacks of the prior art described above, a wafer polishing system is disclosed below that can provide improved polishing performance and flexibility, as well as avoid over-polishing and assist with improving polishing uniformity of wafers produced with difficult to planarize layers such as those produced using copper processes. The wafer polishing system implements a variable partial pad-wafer overlapping (VaPO), also referred to as sub-aperture, polishing technique that maintains a partially overlapping profile between a wafer and a polishing pad so that the pressure may be increased between the wafer and polishing pad, as compared with a fully overlapping profile, with little or no increase in force applied to the pad or wafer. Furthermore, a polishing pad having a reduced surface area is disclosed for further increasing the pressure applied to a wafer and providing additional removal rate flexibility to an existing wafer polisher system.

Figure 1:
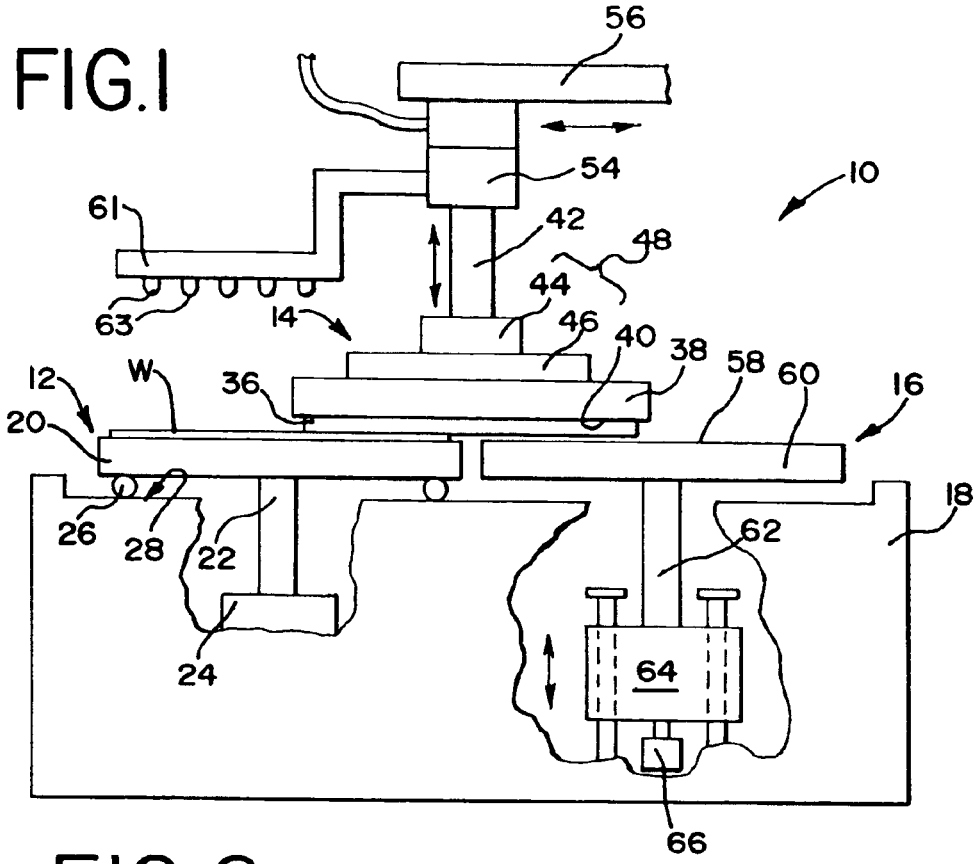
FIG. 1 is a side cut-away view of a semiconductor wafer polishing system according to a preferred embodiment.

A preferred embodiment of a wafer polisher 10 is illustrated in FIG. 1. The polisher 10 includes a wafer carrier assembly 12, a pad carrier assembly 14 and a pad dressing assembly 16. Preferably, the wafer carrier assembly 12 and pad dressing assembly 16 are mounted in a frame 18. The wafer carrier assembly includes a wafer head 20 mounted on a shaft 22 rotatably connected to a motor 24. In a preferred embodiment, the wafer head 20 is designed to maintain a rigid planar surface that will not flex or bend when polishing pressure is received from the pad carrier assembly 14. Preferably, a circular bearing 26, or other type of support, is positioned between the wafer head 20 and an upper surface 28 of the frame 18 along a circumference of the wafer head 20 in order to provide additional support to the wafer head 20. Alternatively, the wafer carrier assembly 20 may be constructed with a shaft 22 having sufficient strength to avoid any deflections.

Figure 2:
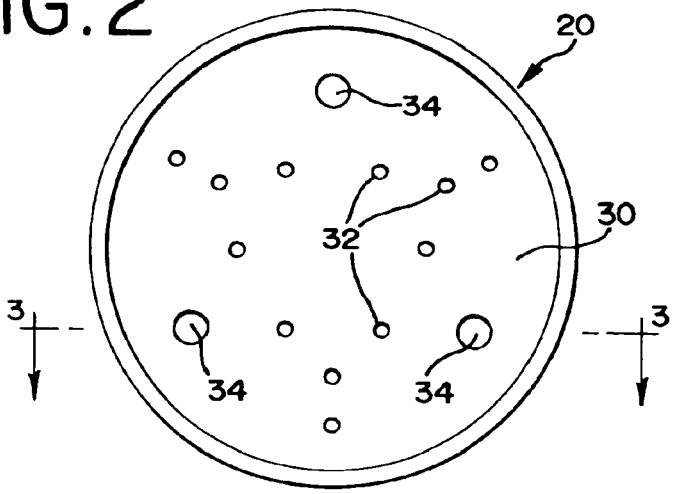
FIG. 2 is a top plan view of a wafer carrier assembly suitable for use in the system of FIG. 1.
Figure 3:
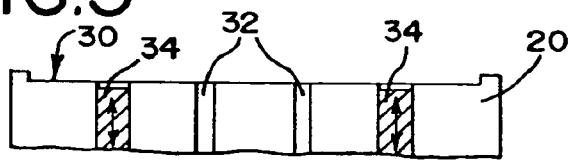
FIG. 3 is a sectional view taken along line 3—3 of FIG. 2.

The wafer head 20 of the wafer carrier assembly 12 is further described with respect to FIGS. 2 and 3. The wafer head 20 preferably has a wafer receiving region 30 for receiving and maintaining a semiconductor wafer in a fixed position during polishing. The wafer receiving area 30 may be a recessed area as shown in FIG. 3 or may be an area centered at the center of rotation of the wafer head 20. Any of a number of known methods for maintaining contact between the wafer and the wafer head 20 during CMP processing may be implemented. In a preferred embodiment, the wafer receiving area 30 of the head 20 includes a plurality of air passages 32 for providing a flow of air, or receiving a vacuum, useful in maintaining or releasing the wafer from the wafer head 20. A porous ceramic or metal material may also be used to allow for a vacuum to be applied to a wafer. Other methods of maintaining the wafer against the wafer carrier, for example adhesives, a circumferentially oriented clamp, or surface tension from a liquid, may be used. One or more wafer lifting shafts 34 are movably positioned between a recessed location within the wafer head and a position extending away from the wafer receiving area 30 of the head 20 to assist in loading and unloading a wafer from a wafer transport mechanism, such as a robot. Each wafer lifting shaft may be operated pneumatically, hydraulically, electrically, magnetically or through any other means. In another preferred embodiment, the wafer head 20 may be fabricated without any wafer lifting shafts 34 and wafers may be loaded or unloaded from the wafer head using a vacuum assisted method.

Referring again to FIG. 1, the pad carrier assembly 14 includes a polishing pad 36 attached to a pad support surface 40 of a pad carrier head 38. The polishing pad 36 may be any of a number of known polishing materials suitable for planarizing and polishing semiconductor wafers. The polishing pad may be the type of pad used in conjunction with abrasive slurry, such as the IC 1000 pad available from Rodel Corporation of Delaware. Alternatively, the pad may be constructed of a fixed-abrasive material that does not require an abrasive containing slurry. Although the diameter of the polishing pad 36 is preferably equal to, or substantially the same as, the diameter of the wafer W, other diameter ratios of the polishing pad and wafer are contemplated. In one embodiment, the polishing pad size may be anywhere in the range of the size of a single die on the wafer to an area twice as large as that of the wafer. Pad dressing surfaces having an area greater than that of the wafer may be advantageous to account for a wider range of motion of the polishing pad, for example in situations where the polishing pad is moved in a manner that would position the center of the polishing pad off of an imaginary line formed between the center of the wafer and the center of the pad dressing surface. In embodiments where more than a single pad dressing head is contemplated, the area of the pad dressing heads is preferably sufficient to condition and support the polishing pad used.

The pad carrier head 38 is preferably attached to a spindle 42 through male and female 44, 46 portions of a tool changer 48. The tool changer preferably allows for interchangeability between pad carrier heads 38 so that different CMP processes may be applied to the same wafer by changing wafer heads and any associated types of abrasive polishing chemistries.

Figure 4:
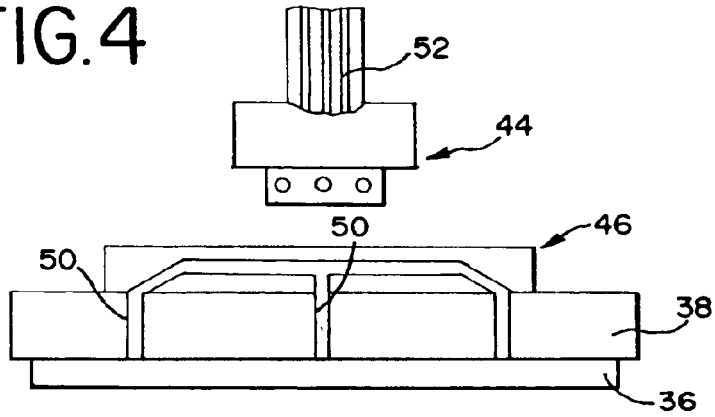
FIG. 4 is an exploded sectional view of a polishing pad carrier assembly and tool changer suitable for use in the system of FIG. 1.

As shown in FIG. 4, a pad 36 may receive abrasive slurry through passages 50 from the pad carrier head 38 and tool changer 44, 46 that are fed by one or more slurries applied lines 52 that may be within the spindle 42. The spindle is rotatably mounted within a spindle drive assembly 54 mounted to a spindle transport mechanism 56. The transport mechanism may be any of a number of mechanical, electrical or pneumatic devices having a controllable reciprocating or orbital motion, or a rotating arm mechanism, that are capable of moving the polishing pad to a plurality of discrete positions on the wafer during a polishing operation.

The spindle drive assembly 54 is designed to rotate the polishing pad 36 on the polishing pad carrier head 38 and it is designed to allow for movement of the spindle to move the polishing pad towards or away from the plane of the wafer W as well as apply a totally controlled polishing pressure to the wafer during CMP processing. It also allows easy access to the pad carrier and facilities assembly automatic replacement of the polishing pad. Any suitable spindle drive assembly, for example a spindle drive assembly such as is used in the TERES™ polisher available from Lam Research Corporation in Fremont, Calif., may be used to accomplish this task. The spindle transport mechanism 56 may be any of a number of mechanical or electrical devices capable of transporting the spindle in a direction coplanar to the wafer W being polished. In this manner, the polishing pad 36 may be precisely positioned and/or oscillated, if required, nearby any particular location along a radius of the wafer W.

A pad dressing/conditioning assembly 16 is preferably positioned adjacent to the wafer carrier assembly and opposite the pad carrier assembly 14. The pad dressing assembly 16 is designed to provide in-situ and/or ex-situ conditioning and cleaning of the polishing pad surface 36.

In one embodiment, the size of the active surface 58 of the pad dressing assembly 16 is preferably substantially the same as the area of the polishing pad. The active surface of the pad dressing assembly may also be larger or smaller than the area of the polishing pad in other embodiments. Additionally, the pad dressing assembly may also consist of multiple rotatable surfaces in other embodiments.

Preferably, the pad dressing assembly 16 has a surface 58 coplanar with the surface of the wafer W being processed The size of the active area of the pad dressing assembly is at least as great as that of the polishing pad 36, consisting of a single or smaller multiple heads). The surface 58 of the pad dressing assembly 16 is affixed to a pad dressing head 60 attached to a shaft 62 rotatably mounted in a motor 64. In order to assist in maintaining the planarity of the pad dressing surface 58 with the wafer W, a plane adjustment mechanism 66 may be used to adjust the position of the pad dressing assembly 16.

In one embodiment, the plane adjustment mechanism 66 may be a mechanical device that may be loosened, adjusted to compensate for height variations, and retightened, between CMP processing runs. In one alternative embodiment, the plane adjustment mechanism may be an active mechanically, or electrically driven device, such as a spring or pneumatic cylinder, that continuously puts an upward pressure on the pad dressing head 60 such that the pressure of the pad carrier assembly 14 against the pad dressing surface 58 maintains a pad dressing surface in a coplanar relationship with the wafer W mounted on the wafer carrier assembly 12. In yet another embodiment, a three point balancing device, having three separately height adjustable shafts, may be used to adjust the plane of the pad dressing surface and/or the wafer carrier head. As with the wafer carrier assembly 12, the pad dressing head 60 may be supported by a circular bearing or may be supported by the shaft 62 alone.

Figure 5A:
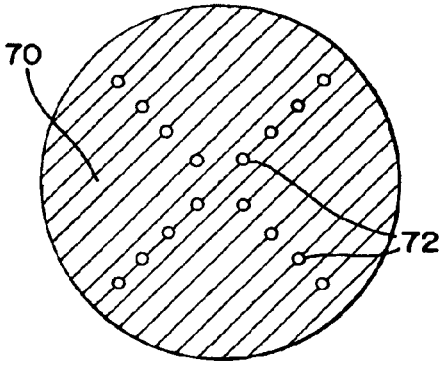
FIGS. 5A–5D illustrate top plan views of different embodiments of a surface of a pad dressing assembly suitable for use in the system of FIG. 1.

Referring to FIGS. 5A–D, several embodiments of preferred pad dressing surfaces positioned on the pad dressing head 60 are shown. In FIG. 5A, the pad dressing surface may be completely covered with a fixed-abrasive media 70 such as alumina, ceria or diamond available from 3M and Diamonex. In addition, a plurality of orifices 72 for transporting a fluid, such as deionized water, slurry or other desired chemistry spray, are dispersed across the surface.

The active surface of the pad dressing assembly may consist of a single dressing feature, such as a diamond coated plate or pad, or may consist of a combination of several pieces of different materials. In other preferred embodiments, the surface of the pad dressing head is divided in sections and includes a set of various standard sized pad conditioning sections, such as a fixed-abrasive unit, a brush and spray unit, sprayers and other types of known pad dressing services. Depending on the desired pad dressing performance, each section of the surface of the pad dressing head may have independently controllable actuators that provide for rotational and up/down motion, and a liquid supply port.

Figure 5B:
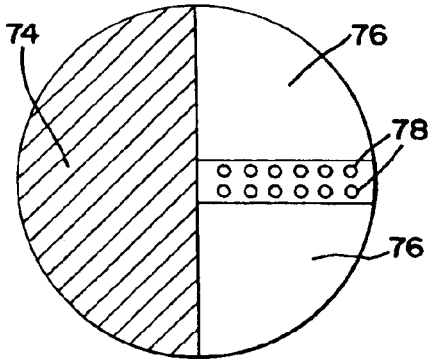
Figure 5C:
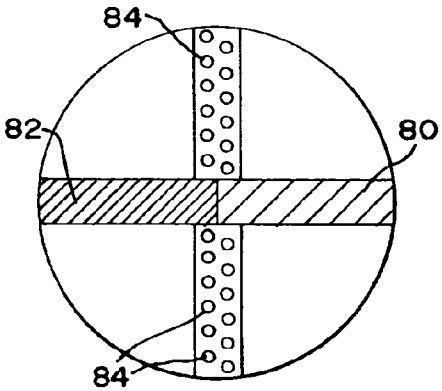
Figure 5D:
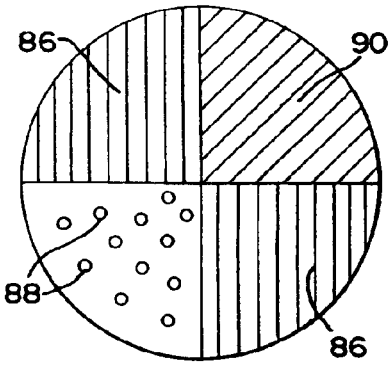

As shown in FIG. 5B, the pad dressing surface may have a fixed-abrasive 74 on one part of the surface, a clean pad 76 on another part of the surface, and an array of fluid dispensing orifices 78 positioned along the clean pad section. The clean pad may be a poromeric material such as Polytex available from Rodel Corporation. In another preferred embodiment, the pad dressing surface may contain a strip of diamond grit 80, a nylon brush 82 positioned along another radius and a plurality of fluid orifices 84 perpendicular to the strip of nylon brush and diamond media as shown in FIG. 5C. Another preferred embodiment is illustrated in FIG. 5D, wherein a fixed-abrasive substance 86 is positioned on opposite quarters of the surface while a plurality of fluid orifices 88 and a clean pad 90 are each positioned on a respective one of the remaining two quarters of the surfaces. Any of a number of configurations of abrasive material to abrade and condition the pad, a fluid to rinse the pad, and/or clean pad materials may be utilized. Additionally, any suitable fixed-abrasive or fluid may be used.

The polisher 10 of FIGS. 1–5 is preferably configured with the wafer carrier assembly and pad dressing assembly having a co-planar relationship between their respective surfaces. As provided above, the co-planarity may be manually adjusted or self-adjusting. Also, the pad dressing head and wafer carrier head are preferably positioned as close together radially as possible so that the maximum amount of polishing pad material will be conditioned. Preferably, the surface of the pad dressing head is large enough, and positioned close enough to the wafer carrier, such that the entire polishing pad is conditioned after one complete rotation of the pad. In other embodiments, multiple pad dressing devices may be used to condition the same or different portions of the pad. In these alternative pad dressing embodiments, the surface of each pad dressing assembly may be arrayed radially with respect to the wafer carrier head, or may be arrayed in any other desired fashion.

In a preferred embodiment, each of the wafer carrier, pad carrier, and pad dressing assemblies may be constructed having heads that are non-gimbaled. In another embodiment, the pad carrier head may be a gimbaled head, such as those commonly known in the industry, to compensate for minor inaccuracies in the alignment of the interacting wafer surface, polishing pad and pad dressing surface. Also, the wafer carrier head and pad dressing head are preferably oriented with their respective surfaces facing in an upward direction, while the pad carrier head faces downward. An advantage of this wafer up configuration is that it can assist in improved in-situ surface inspection, end point detection and direct supply of liquids to the wafer surface. In other embodiments, the wafer and pad dressing heads, and the opposing pad carrier head, may be oriented parallel to a non-horizontal plane, such as a vertical plane, or even completely reversed (i.e., polishing pad facing up and wafer and pad dressing surface facing down) depending on space and installation constraints.

Figure 6:
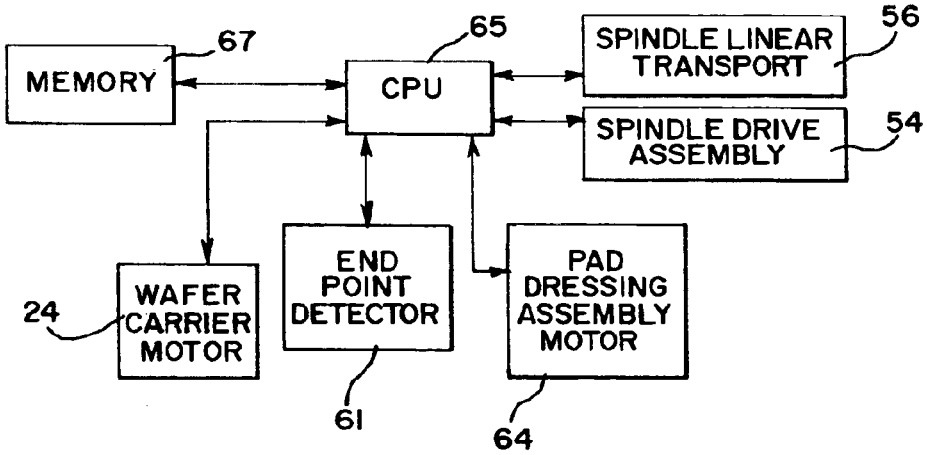
FIG. 6 is a block diagram illustrating the communication lines between the microprocessor and the individual components of the polisher of FIG. 1.

As shown in FIG. 6, the polisher 10 is controllable by a microprocessor (CPU) 65 based on instructions stored in a programmable memory 67. The instructions may be a list of commands relating to wafer specific polishing schemes that are entered or calculated by a user based on a combination of operational parameters to be sensed or maintained by the various components of the polisher. These parameters may include rotational speed of the carrier heads for the pad, wafer and pad dressing components, position/force information from the spindle drive assembly 54, radial pad position information from the spindle linear transport mechanism 56, and polishing time as maintained by the CPU and adjusted in process by information from the end point detector 61. The CPU is preferably in communication with each of the different components of the polisher.

Figure 7:
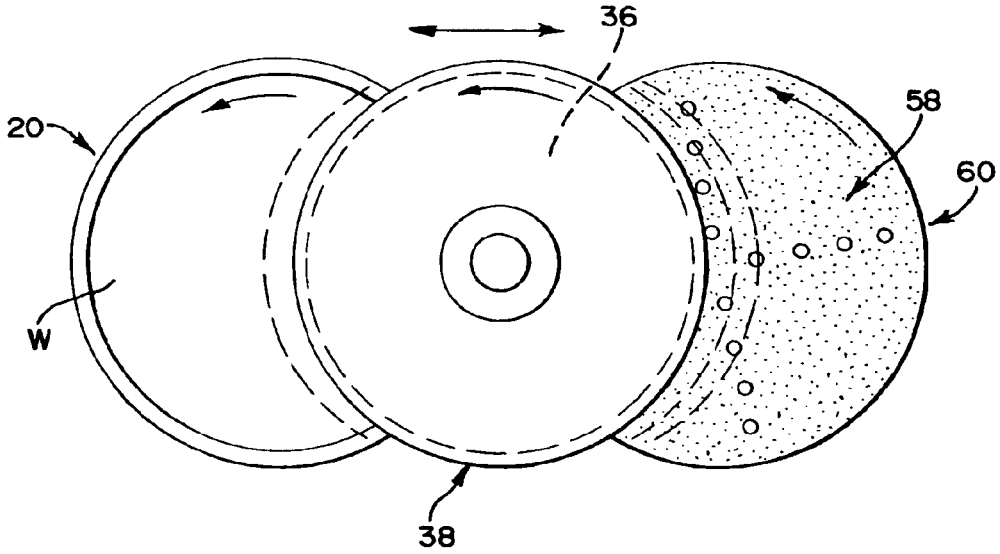
FIG. 7 is a top plan view illustrating the movement of the components of the system of FIG. 1.

With reference to the polisher 10 described in FIGS. 1–6 above, operation of the polisher is described below. After a wafer is loaded onto the wafer carrier, the polishing pad is lowered by the spindle drive assembly such that polishing pad overlaps only a portion of the surface of the wafer as shown in FIG. 7. Although the polisher can be operated to completely cover the surface of the wafer with the pad, the pad is preferably only covering, and in contact with, a portion of the wafer surface at any given time. Also, a portion of the polishing pad that is not covering the wafer is preferably covering, and in contact with, the surface of the pad dressing assembly. Thus, as one portion of the polishing pad rotates and presses against a portion of the rotating wafer, another portion of the polishing pad is rotating against the rotating surface of the pad dressing assembly to clean and condition the polishing pad during the wafer processing. The pad dressing assembly may also be used to clean and condition the pad after wafer processing, or even used both during and after wafer processing. Preferably the entire polishing pad is utilized in this continuous process of polishing and pad conditioning.

Preferably, the polisher 10 is capable of addressing regional variations in uniformity on a wafer-by-wafer basis. This function is achieved by first obtaining profile information on each wafer and then calculating a polishing strategy for the polisher to address the particular non-uniformities of each wafer. The wafer profile information may be obtained from earlier measurements determined in processing earlier layers of the particular wafer, or may be measured expressly before the wafer is processed. Any one of a number of known profile measurement techniques may be used to obtain the necessary profile data. For example, a resistance measurement using a four-point probe, or sound speed measurements, may be taken at points from the center of the wafer to the edge to determine profile properties. These properties may be used in conjunction with the previously measured properties of the polishing pad (for example, the measured polishing response at various points along the radius of the polishing pad) to calculate the best polishing scheme (e.g., polishing pad path, rotational speed of the wafer and pad, downforce applied to the pad, and time at each point on the polishing path) and store these instructions in the polisher memory for execution by the CPU.

Prior to, and after, polishing the wafer, the wafer lifting shafts 34 in the wafer carrier assembly 12 are activated to lift the wafer from the wafer receiving surface and transfer the wafer to or from the wafer carrying robot. Also, during the CMP process on a particular wafer, it is preferred that the wafer, polishing pad, and pad dressing surface all rotate in the same direction. Other combinations of rotational directions are contemplated and rotational speed of the individual assemblies may vary and be varied purposefully during a particular polishing run.

Once the polishing scheme is determined and stored, and the wafer is properly mounted in the wafer carrier, polishing may progress according to the predetermined polishing scheme. The pad, wafer and pad dressing surface will all be rotated at a desired speed. Suitable rotational speeds for the pad, wafer and pad dressing surface may be in the range of 0–700 revolutions per minute (r.p.m.). Any combination of rotational speeds and rotational speeds of greater than 700 r.p.m. are also contemplated. The linear transport mechanism for the spindle will position the edge of the pad at the first point along the radius of the wafer and the spindle drive assembly will lower the pad until it reaches the surface of the wafer and the desired pressure is applied. The polishing pad preferably only covers a portion of the wafer and continues to polish the wafer until the desired polishing time has expired. Preferably, the process status inspection system, which may be an end point detector 61 (FIG. 1) having one or more transmitter/receiver nodes 63, communicates with the CPU to provide in-situ information on the polishing progress for the target region of the wafer and to update the original polishing time estimate. Any of a number of known surface inspection and end point detection methods (optical, acoustic, thermal, etc.) may be employed. While a predetermined polishing strategy may be applied to each individual wafer, the signal from surface inspection tool may be used for precise adjustment of the time spent by the polishing pad at each location.

After polishing the first region of the wafer, the linear index mechanism moves the polishing pad to the next position and continues polishing at that next region. The polishing pad preferably maintains contact with the surface of the wafer as it is moved to the next radial position. Additionally, while the polisher may move the polishing pad from a first position, where the edge of the polishing pad starts at the center of the wafer, to subsequent positions radially away from the center in consecutive order until the wafer edge is reached, the profile of a particular wafer may be best addressed by moving in different directions or in non-radial paths. For example the first polish operation may start with the edge of the polishing pad at a point in between the center and edge of the wafer and the polisher may move the polishing pad to positions along the wafer radius toward the edge, and finishing with a final polish with the edge of the pad at the center of the wafer.

During polishing, the polishing pad is preferably constantly in contact with the surface of the pad dressing assembly. The pad dressing assembly conditions the pad to provide a desired surface and cleans by-products generated by the polishing process. The abrasive material on the surface of the pad dressing assembly preferably activates the pad surface while pressurized deionized water or other suitable chemical cleanser is sprayed through the orifices in the surface and against the pad.

Using the CPU to monitor the pressure applied by the spindle to the pad carrier head and controllably rotate the pad carrier head and the wafer, the polishing process proceeds until the end point detector indicates that the polisher has finished with a region. Upon receiving information from the end point detector, the CPU instructs the spindle linear transport mechanism 56 to radially move the polishing pad with respect to the center of the wafer to draw the polishing pad away from the center of the wafer and focus on the next annular region of the wafer. Preferably, the pad and the wafer maintain contact while the pad is withdrawn radially towards the edge of the wafer. In a preferred embodiment, the spindle linear transport mechanism 56 may simply index in discrete steps movement of the pad. In another preferred embodiment, the spindle mechanism 56 may index between positions and oscillate back and forth in a radial manner about each index position to assist in smooth transitions between polish regions on the wafer.

In another embodiment, the linear spindle transport mechanism may move in discrete steps, maintain the spindle in a fixed radial position after each step and make use of a polishing pad that is offset from the center of rotation of the polishing pad carrier to provide an oscillating-type movement between the pad and the wafer. As is apparent from the figures, the polishing pad not only maintains constant contact with the wafer, it also maintains constant contact with the surface of the pad dressing assembly. Each rotation of the polishing pad will bring it first across the wafer and then into contact with various portions of the surface of the pad dressing assembly.

The polisher 10 may be configured to allow for the pad to completely overlap the wafer, however the pad preferably indexes between various partially overlapping positions with respect to the wafer to assist in following a desired material clearance or material thickness profile. Advantages of this configuration and process include the ability to focus on the amount of material removed various annular portions of the wafer to provide greater polish control and avoid non-uniformity and over polish problems often associated with polishing an entire surface of a wafer simultaneously. Further, the partial overlapping configuration permits simultaneous and continuous, whole-pad inspection and in-situ pad conditioning.

Although a single pad dressing assembly is shown, multiple pad dressing assemblies may also be implemented. An advantage of the present polisher 10 is that in-situ pad conditioning may be performed simultaneously with in-situ surface inspection and upper layer thickness measurement/end point detection based on the fact that the wafer and polishing pad preferably do not completely overlap. Additionally, by starting the overlap of the pad and wafer at a point no greater than the radius of the polishing pad, the polishing pad may be completely conditioned each rotation. Furthermore, cost savings may be achieved by fully utilizing the surface of the polishing pad. Unlike several prior art systems, where the polishing pad is significantly larger than the wafer being polished, the entire surface of the polishing pad is potentially utilized.

Figure 8:
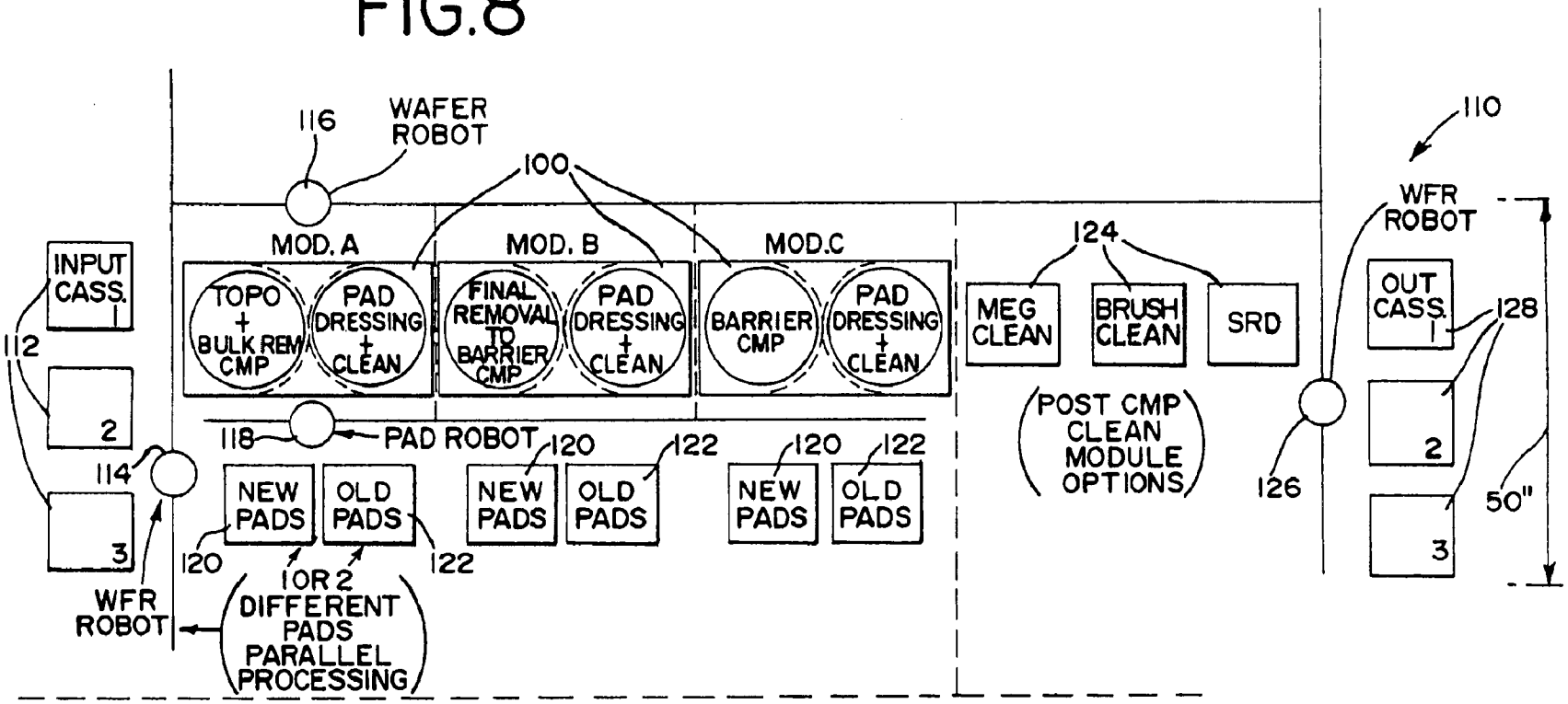
FIG. 8 is a diagram illustrating a wafer processing system incorporating the wafer polisher of FIG. 1.

In other embodiments, the polisher 10 shown in FIGS. 1–7 may be used as a module 100 in a larger wafer processing system 110 as shown in FIG. 8. In the system of FIG. 8, multiple modules are linked in series to increase wafer throughput. The wafer processing system 110 preferably is configured to receive semiconductor wafers, loaded in standard input cassettes 112, that require planarization and polishing. A wafer transport robot 114 may be used to transfer individual wafers from the cassettes to the first module 100 for polishing. A second wafer transport robot may be used to transfer the wafer to the next module upon completion of processing at the first module as described with respect to the polisher 10 of FIG. 1. The system 110 may have as many modules 100 as desired to address the particular polishing needs of the wafers. For example, each module could be implemented with the same type of pad and slurry combination, or no slurry if fixed-abrasive techniques are used, and each wafer would be partially planarized at each module such that the cumulative effect of the individual polishes would result in a completely polished wafer after the wafer receives its final partial polish at the last module.

Alternatively, different pads or slurries could be used at each module. As described above with respect to the polisher of FIG. 1, each polisher module 100 may change polishing pad carriers through the use of a tool changer. This additional flexibility is attainable in the system of FIG. 8 through the use of a pad robot 118 that may cooperate with the spindle drive assembly of each module to switch between pads automatically without the need to dismantle the entire system. Multi-compartment pad carrier head storage bins for fresh pads 120 and used pads 122 may be positioned adjacent each module to permit efficient changing of pad carrier heads attached to worn pads with pad carrier heads having fresh pads. Utilizing a cataloging mechanism, such as a simple barcode scanning technique, wafer pad carriers having different types of pads may be catalogued and placed at each module so that numerous combinations of pads may be assembled in the system 100.

After planarization, the second wafer robot 116 may pass the wafer on to various post CMP modules 124 for cleaning and buffing. The post CMP modules may be rotary buffers, double sided scrubbers, or other desired post CMP devices. A third wafer robot 126 removes each wafer from the post CMP modules and places them in the output cassettes when polishing and cleaning is complete.

In an alternative embodiment of the polisher of FIG. 1, a polishing pad constructed of a fixed-abrasive material is used where the fixed-abrasive material is formed with a circular outer circumference and extends radially inward only a portion of the way to the center of the pad forming an annular shape. A region lacking fixed-abrasive polishing material is bounded by the fixed-abrasive material. Preferably, the region lacking fixed-abrasive polishing material is symmetric about a diameter of the polishing pad. The region lacking fixed-abrasive material reduces the total surface area of the polishing pad, as compared to standard rotary pads having substantially their entire surface occupied by polishing pad material, and thus can provide a way of increasing the point-load pressure that may be applied to a semiconductor wafer from the same amount of downforce available from the polisher.

Figure 9:
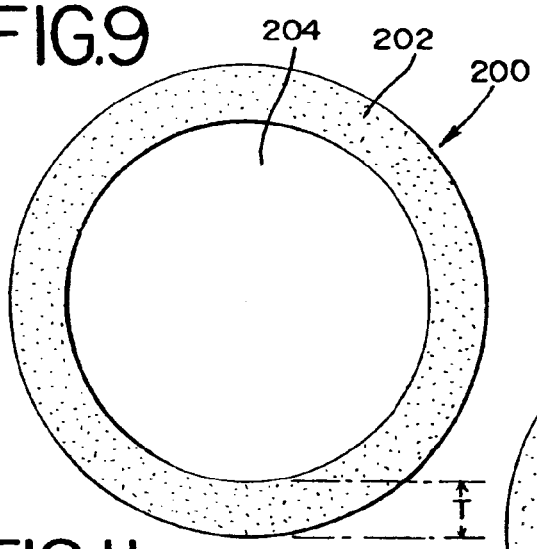
FIG. 9 is a fixed-abrasive rotatable polishing pad for use in the polisher of FIG. 1 according to a preferred embodiment.
Figure 10:
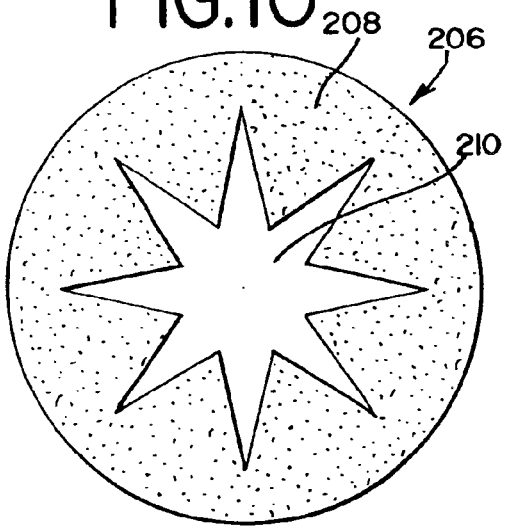
FIG. 10 is a fixed-abrasive rotatable polishing pad for use in the polisher of FIG. 1 according to a second preferred embodiment.
Figure 11:
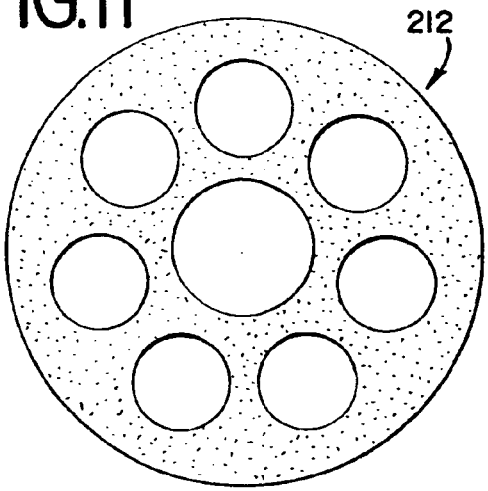
FIG. 11 is a fixed-abrasive rotatable polishing pad for use in the polisher of FIG. 1 according to a third preferred embodiment.
Figure 12:
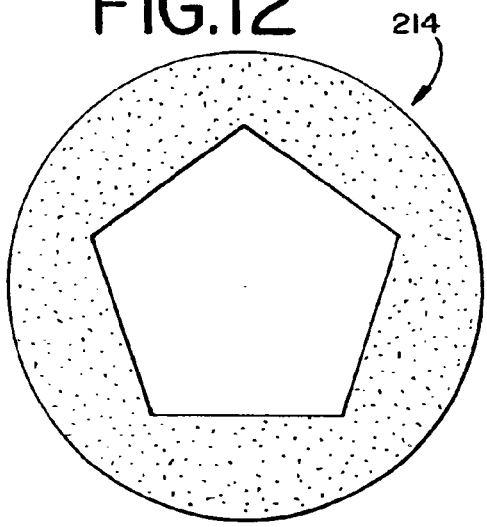
FIG. 12 is a fixed-abrasive rotatable polishing pad for use in the polisher of FIG. 1 according to a fourth preferred embodiment.

In one preferred embodiment, shown in FIG. 9, the polishing pad 200 has an annular region 202 of fixed-abrasive material, where the central region 204 without fixed-abrasive material is substantially circular. Another version of a polishing pad 206 having fixed-abrasive material over a peripheral portion 208 of the pad is shown in FIG. 10. In this embodiment, the fixed-abrasive material has a substantially circular outer circumference and defines a central region 210 lacking fixed-abrasive material that is in the shape of a star-like pattern. Other configurations, such as the fixed-abrasive polishing pads 212, 214 of FIGS. 11–12 may also be used to decrease the surface area of fixed-abrasive material and change the removal rate characteristics of the polishing pad. Preferably, a reduced surface area polishing pad is selected with a particular reduction in the surface area that will contact a wafer to achieve a desired increase in loading. The particular shape of the polishing pad may be adjusted to meet non-uniformity requirements for a particular process.

The fixed-abrasive material may be any of a number of commercially available fixed-abrasives suitable for planarizing semiconductor wafers. Examples of these types of fixed-abrasives include the slurry free CMP materials available from 3M Corporation of St. Paul, Minn. The fixed-abrasive pads illustrated in FIGS. 9–12 may be adhered to the pad carrier head 23 using any of a number of standard adhesives.

In the annular polishing pad embodiment of FIG. 9, the fixed-abrasive annular pad preferably has an outer diameter greater than or equal to the diameter of the wafers to be planarized. The thickness T of the annulus may be chosen to correspond with the pressure needed to activate the fixed-abrasive media and the force application limitations of the spindle drive assembly, or the removal profiles desired. Thus, knowing the pressure requirements inherent in the fixed-abrasive media to obtain optimal planarization characteristics from the fixed-abrasive media, and knowing the range of force that the spindle drive assembly can apply to the polishing pad carrier, a thickness T is chosen to provide a contact area that allows operation of the polishing pad within the optimal pressure range during wafer processing. In one embodiment, the thickness of the annulus may be in the range of 0.5 inches to 3.0 inches. An advantage of the reduced surface area, fixed-abrasive polishing pads of FIGS.

9–12 is that improved die level performance can be achieved at high down forces, typically unobtainable using conventional wafer-scale polish platforms.

Preferably, the pad dressing assembly 16 for the reduced surface area pads of FIGS. 9–12 is the same as described above with respect to FIG. 1. The pad dressing head 60 may include any number of combinations of abrasives and fluid orifices appropriate to prepare the fixed-abrasive polishing material on the polishing pad and to remove released fixed-abrasive material from the polishing pad so as to reduce defects. Dressing of the fixed-abrasive material may also be accomplished by this method to maintain exposure of fresh fixed-abrasive.

As mentioned above, an advantage of the fixed-abrasive annular polishing pad is that the area of contact is less than that of a standard circular/rotary pad. The lesser contact area allows for increased pressure to be applied against the wafer for a given amount of force applied to the pad carrier head. In a preferred embodiment, a pressure of 15–30 pounds per square inch (p.s.i.) is applied to the wafer surface of an 8-inch wafer using a fixed-abrasive polishing pad. In contrast, typical dispersed-abrasive processes require less than 15 p.s.i. By using an annular pad that has a load-bearing cross-section smaller than the area of the wafer, high local downforces can be achieved to obtain good planarization efficiency from the fixed-abrasive media. The annular shape of the fixed-abrasive annular polishing pad permits use of exisiting spindle drive assemblies and can help avoid the cost, size and weight of more powerful downforce mechanisms.

Although the fixed-abrasive polishing pads described with respect to FIGS. 9–12 may be used in the polisher 10 of FIG. 1 to provide a highly planarized finish to the semiconductor wafer, the low defect wafer polish finish properties of a dispersed-abrasive process are often desirable. According to a preferred embodiment, a polishing system, such as the polishing system 110 of FIG. 8, includes a VaPO polishing module 100 having a reduced surface area, fixed-abrasive polishing pad, and a dispersed-abrasive polishing module 100 for the second step. The dispersed-abrasive step may be performed on a standard rotary polisher with a polishing pad that completely overlaps the semiconductor wafer surface, a linear polishing module that has a polishing belt width greater than the width of the wafer, or a VaPO polisher, such as illustrated in FIG. 1, where only a portion of the non-abrasive polishing pad contacts the semiconductor wafer with a dispersed-abrasive slurry media. In yet another preferred embodiment, the dispersed-abrasive step may be executed at the same VaPO polishing station, such as shown in FIG. 1, used for the fixed-abrasive step. This may be accomplished by using the pad robot 118 to substitute a pad carrier assembly having a non-abrasive polishing pad for the pad carrier assembly holding the fixed-abrasive pad.

Figure 13:
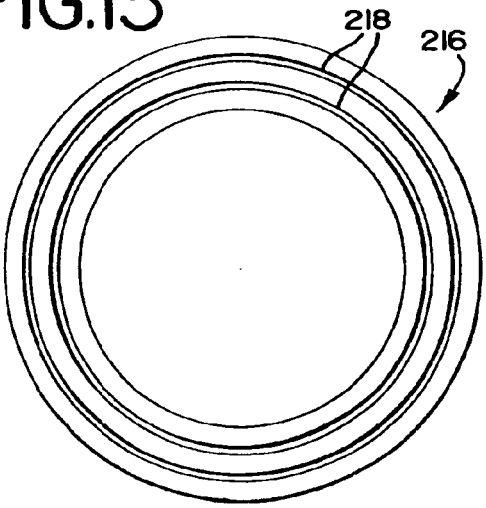
FIG. 13 is a non-abrasive rotatable polishing pad for use with a dispersed abrasive in the polisher of FIG. 1 according to a preferred embodiment.

An example of a suitable VaPO, non-abrasive polishing pad 216 is illustrated in FIG. 13. This pad 216 includes concentric grooves 218 for aiding in the transport of dispersed-abrasive slurry during the dispersed-abrasive process. The dispersed-abrasive slurry applied to the non-abrasive pad may be a ceria-based, $SiO_2$-based, $Al_2O_3$-based or other known dispersed-abrasive suitable for the type of wafer material being polished.

Figure 14:
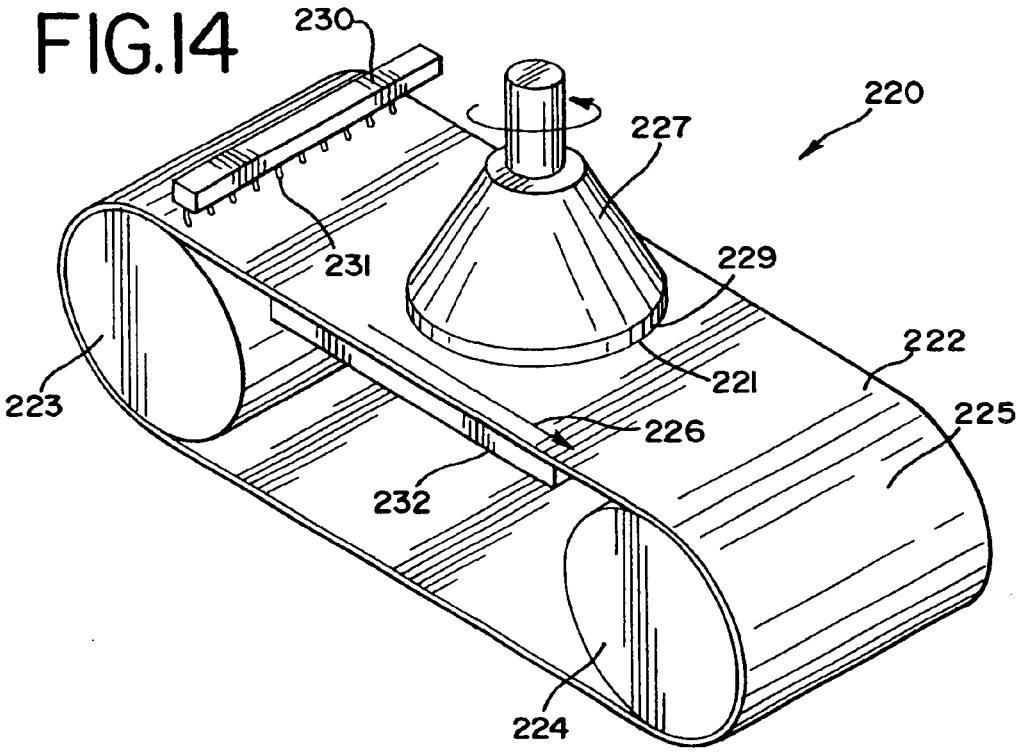
FIG. 14 is a perspective view of a linear belt polisher suitable for use in polishing semiconductor wafers.

Alternatively, a linear belt polisher may be used rather than a VaPO rotary device or standard rotary polisher. A suitable linear belt polisher for use in accomplishing both the fixed-abrasive and the dispersed-abrasive step of the preferred polishing process is the linear belt polishing module used in the TERES™ CMP System available from Lam Research Corporation of Fremont, Calif. An example of a linear belt polisher is shown in FIG. 14. The linear polisher 220 utilizes a belt 222, which moves linearly in respect to the surface of the wafer 221. The belt 222 is a continuous belt rotating about rollers (or spindles) 223 and 224, in which one roller or both is/are driven by a driving means, such as a motor, so that the rotational motion of the rollers 223–224 causes the belt 222 to be driven in a linear motion (as shown by arrow 226) with respect to the wafer 221. A polishing pad 225 is affixed onto the belt 222 at its outer surface facing the wafer 221.

The wafer 221 typically resides on a wafer carrier 227. The wafer 221 is held in position by a mechanical retaining means, such as a retainer ring 229, to prevent horizontal movement of the wafer when the wafer 221 is positioned to engage the pad 15. Generally, the wafer carrier 227 containing the wafer 221 is rotated, while the belt/pad moves in a linear direction 226 to polish the wafer 221. For dispersed-abrasive process steps, the linear polisher 220 also includes a slurry dispensing mechanism 230, which dispenses a slurry 231 onto the pad 225. A pad conditioner (not shown) is typically used in order to recondition the pad 225 during use. Techniques for reconditioning the pad 225 during use are known in the art and generally require a constant dressing of the pad in order to remove the residue build-up caused by used slurry and removed waste material.

A support or platen 232 is disposed on the underside of the belt 222 and opposite from carrier 227, such that the belt/pad assembly resides between the platen 232 and wafer 221. The platen 232 provides a supporting platform on the underside of the belt 222 to ensure that the pad 225 makes sufficient contact with wafer 221 for uniform polishing. In operation, the carrier 227 is pressed downward against the belt 222 and pad 225 with appropriate force, so that the pad 225 makes sufficient contact with the wafer 221 for performing CMP. Because the belt 222 is flexible and will depress when the wafer is pressed downward onto the pad 225, the platen 232 provides a necessary counteracting support to this downward force (also referred to as downforce).

The platen 232 can be a solid platform or it can be a fluid bearing. Preferably, a fluid bearing is used so that the fluid flow from the platen can be used to adjust forces exerted on the underside of the belt 222. In this manner, pressure variations exerted by the pad on the wafer can be adjusted to provide a more uniform polishing rate of the wafer surface. An example of a suitable fluid platen is disclosed in U.S. Pat. No. 5,558,568, the entire disclosure of which is incorporated herein by reference. Further details relating to linear belt polishing modules that are suitable for use in the present system may be found in U.S. Pat. No. 5,692,947, entitled "Linear Polisher and Method for Semiconductor Wafer Planarization," the entire disclosure of which is incorporated herein by reference.

Figure 15:
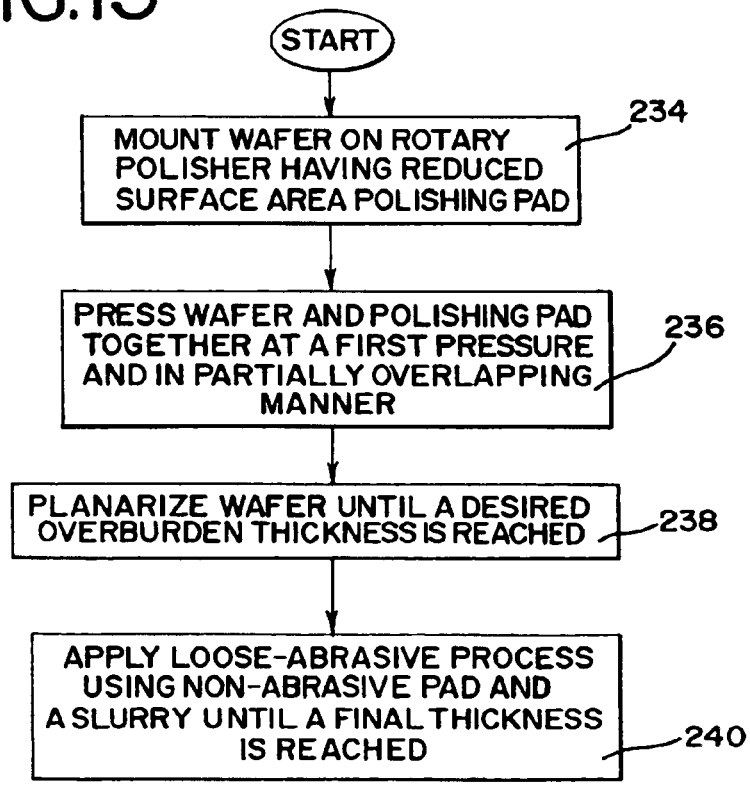
FIG. 15 illustrates a method of processing semiconductor wafers using the polisher and polishing system of FIGS. 1 and 8.

Combining the polishing techniques of fixed-abrasives and dispersed-abrasives, a preferred method of planarizing a semiconductor wafer will now be described with reference to FIGS. 8 and 15. A semiconductor wafer W is first mounted in a VaPO polishing module having either a full-size or a reduced surface area (e.g. annular), fixed-abrasive pad (at 234). The wafer and the polishing pad are rotated and brought into partially overlapping contact with each other and the polishing pad also partially overlaps the surface of the pad dressing assembly. A non-abrasive fluid such as potassium hydroxide or ammonium hydroxide in the case of oxide planarization, or deionized (Dl) water may be applied to assist in the fixed-abrasive planarization process. A first pressure is maintained between the rotating polishing pad and wafer (at 236). As illustrated in FIG. 7, the pad carrier assembly of the polishing module may be moved to a plurality of partially overlapping positions with the wafer along a radius of the wafer during planarization. The fixed-abrasive planarization process continues until the step height is reduced to a desired value (for example, 80% of the original step height) and a first overburden thickness is reached (at 238). This is typically achieved by the self-stopping capability of the fixed-abrasive process, where the fixed-abrasive material is no longer activated by unevenness in the wafer once the wafer layer has been planarized. Alternatively, this may be detected by in-situ end point detection and wafer surface inspection metrology, such as a standard optical inspection device in one preferred embodiment. Preferably, the pad dressing element is configured as sufficiently abrasive to precondition the surface of a new fixed-abrasive polishing pad. In addition, the pad dressing element is configured to remove used abrasive and planarization by-products from the polishing pad as required during the planarization process.

After the fixed-abrasive treatment, the wafer is subjected to a dispersed-abrasive process. The dispersed-abrasive process utilizes a non-abrasive polishing pad such as the IC1000 polyurethane pad manufactured by Rodel Corporation, and a conventional polishing slurry. In a preferred embodiment, the dispersed-abrasive process is performed on a separate polishing module such that a wafer robot removes the wafer from the first polishing module and then places it a wafer holder for the second, dispersed-abrasive polishing module. As with the first, fixed-abrasive module, the wafer and the polishing pad are rotated and pressed together. The dispersed-abrasive polishing module preferably maintains a pressure between the wafer and the polishing pad that is less than was maintained between the fixed-abrasive pad and wafer on the first polishing module. While the dispersed-abrasive pad is pressed against the wafer, a polishing slurry is deposited on the pad and/or wafer to facilitate the polishing process. The pad dressing assembly for the non-abrasive pad is selected to sufficiently dress (i.e. restore the surface activity of) the polishing pad and remove polishing by-product as polishing proceeds. The dispersed-abrasive polish process continues until a final desired thickness and/or surface state is reached for the current wafer layer (at 240).

Several variations of the dispersed-abrasive process may be implemented. As indicated above, the dispersed-abrasive process may be executed on the same polishing module as the fixed-abrasive process by switching the pad holder assemblies and applying polishing slurry to the non-abrasive pad selected for the dispersed-abrasive process. In the embodiment using two or more separate polishing modules, the dispersed-abrasive polishing step may be accomplished with a VaPO polisher identical to that of the fixed-abrasive step but having a reduced surface non-abrasive area pad, or it may be accomplished using standard rotary or linear belt polishers.

The hybrid polishing technique described above, where a VaPO polisher or polishers first apply a fixed abrasive pad to a wafer and then apply a dispersed abrasive, is preferably applied to patterned wafers. Patterned wafers are defined herein as wafers having one or more layers of etched or deposited circuitry. A patterned wafer may have one or a plurality of copies of the same circuit design. Additionally, the hybrid polishing technique achieves planarization of the subject wafer by planarizing with each of the two different processes. Preferably, each of the fixed-abrasive and dispersed-abrasive processes are used to remove at least 500–1000 angstroms of a particular wafer layer. Other amounts of removal by each of the two processes in the hybrid polishing technique are also contemplated and may be adjusted to the type or constitution of the particular patterned wafer.

In an alternative embodiment, the hybrid polishing technique discussed above may be applied to patterned wafers by using standard rotary polishers, or standard linear belt polishers, for both the initial fixed abrasive planarization step and the subsequent dispersed-abrasive planarization step. In this embodiment, the wafer polishers use polishing pads that cover the entire surface of a patterned wafer at any give instant in the fixed-abrasive and dispersed abrasive planarization steps. Standard end-point detection techniques may be used to automatically determine when desired amounts of material have been removed from a given layer of the patterned wafer. As set forth above, a polishing system and method have been described that provide for increased flexibility of a VaPO polisher to provide a variety removal rate distributions. The flexibility may be achieved by providing reduced surface area polishing pads that can avoid the need to use larger and heavier polishers to achieve the necessary pressures. In addition, a method of processing patterned wafers by linking an initial fixed-abrasive process, that may use reduced surface area fixed-abrasive polishing pads on a VaPO polisher, and a subsequent dispersed-abrasive process allows for improved planarization qualities while maintaining relatively low defect wafer surface finishes.

The invention may be embodied in other forms than those specifically disclosed herein without departing from its spirit or essential characteristics. The described embodiments are to be considered in all respects only as illustrative and not restrictive, and the scope of the invention is intended to be commensurate with the appended claims.

We claim:

1. A method of planarizing and polishing semiconductor wafers comprising:

rotating a first polishing pad about a central axis, wherein the polishing pad has a polishing pad material comprising a fixed-abrasive material positioned along a circumference of the first polishing pad and extending radially inwardly a portion of a radius of the first polishing pad, and wherein the polishing pad material defines a central region lacking polishing pad material and symmetric about a diameter of the first polishing pad;

pressing a portion of the polishing pad material on the first polishing pad against a portion of a rotating semiconductor wafer, wherein the first polishing pad partially overlaps the semiconductor wafer;

maintaining a first pressure between the first polishing pad and the semiconductor wafer;

planarizing the semiconductor wafer with the first polishing pad until a first wafer film thickness is achieved;

disengaging the first polishing pad from the semiconductor wafer; and applying a dispersed-abrasive polishing process to the semiconductor wafer until a final wafer film thickness is reached.

2. The method of claim 1 wherein maintaining a first pressure comprises maintaining a pressure of at least 15 pounds per square inch between the polishing pad and the semiconductor wafer.

3. The method of claim 1 wherein maintaining a first pressure comprises maintaining a pressure of at least 2 pounds per square inch between the polishing pad and the semiconductor wafer.

4. The method of claim 1 wherein applying a dispersed-abrasive process comprises:

pressing the semiconductor wafer against a second polishing pad;

applying a chemical slurry to the second polishing pad while the semiconductor wafer and the second polishing pad move against each other; and maintaining a second pressure between the second polishing pad and the semiconductor wafer.

5. The method of claim 4 wherein the second polishing pad has a non-abrasive polishing pad material positioned along a circumference of the second polishing pad and extending radially inwardly a portion of a radius of the second polishing pad, wherein the polishing pad material defines a central region lacking polishing pad material and symmetric about a diameter of the second polishing pad.

6. The method of claim 4 wherein the second polishing pad comprises a non-abrasive polishing pad material.

7. The method of claim 6 wherein the polishing pad material comprises an annular surface.

8. The method of claim 4 wherein the second polishing pad comprises a linear belt constructed of non-abrasive polishing pad material.

9. The method of claim 4 wherein the second pressure is less than the first pressure.

10. The method of claim 1 wherein the polishing pad material comprises an annular surface.

* * * * *